US009277313B2

(12) United States Patent
Zhou et al.

(10) Patent No.: US 9,277,313 B2
(45) Date of Patent: Mar. 1, 2016

(54) COUNTER BALANCING APPARATUS FOR MOVING-IRON BONE-CONDUCTED SOUND RECEIVING DEVICE

(75) Inventors: Wei Zhou, Suzhou (CN); Liang Li, Suzhou (CN)

(73) Assignee: SUZHOU HEARONIC ELECTRONICS, Suzhou (CN)

( * ) Notice: Subject to any disclaimer, the term of this patent is extended or adjusted under 35 U.S.C. 154(b) by 0 days.

(21) Appl. No.: 14/401,993

(22) PCT Filed: Jun. 6, 2012

(86) PCT No.: PCT/CN2012/076536

§ 371 (c)(1),
(2), (4) Date: Nov. 18, 2014

(87) PCT Pub. No.: WO2013/170506

PCT Pub. Date: Nov. 21, 2013

(65) Prior Publication Data

US 2015/0156582 A1 Jun. 4, 2015

(30) Foreign Application Priority Data

May 18, 2012 (CN) ..... 2012 1 0154134

(51) Int. Cl.
*H04R 25/00* (2006.01)
*H04R 1/46* (2006.01)
*H04R 11/04* (2006.01)

(52) U.S. Cl.
CPC . *H04R 1/46* (2013.01); *H04R 11/04* (2013.01)

(58) Field of Classification Search
CPC ..... H04R 11/02; H04R 25/00; H04R 25/456; H04R 25/604; H04R 7/06; H04R 11/00; H04R 31/00; H04R 31/006; H04R 11/04; H04R 7/20; H04R 11/06; H04R 2460/13; H04R 7/04
USPC ..... 381/417, 418, 419, 312, 345, 412, 162, 381/151; 310/43, 51
See application file for complete search history.

(56) References Cited

U.S. PATENT DOCUMENTS 3,502,822 A * 3/1970 Knauert et al. ..... 381/419
4,126,769 A * 11/1978 Broersma ..... H04R 7/04 381/418

(Continued)

FOREIGN PATENT DOCUMENTS

CN 101322435 A 12/2008
CN 202587363 U 12/2012

OTHER PUBLICATIONS

Jan. 31, 2013 International Search Report issued in Application No. PCT/CN2012/076536.

(Continued)

*Primary Examiner* — Davetta W Goins
*Assistant Examiner* — Phylesha Dabney
(74) *Attorney, Agent, or Firm* — Oliff PLC

(57) ABSTRACT

A counter balancing apparatus for moving-iron bone-conducted sound receiving device; the baseboard is configured in a planar structure, with open notch on its front end; two counter-balancing blocks configured in a planar structure and provide symmetry on both sides of the baseboard, and an open notch formed on the front end of each of the counter-balancing blocks aligns with the open notch on the front end of the baseboard. The invention increases effective moving mass of its counter balancing apparatus and optimizes space occupied by its counter balancing apparatus, enhancing transduction efficiency and output vibration level of the corresponding moving-iron bone-conducted sound receiving device; controlling the product size; the baseboard split type design and counter-balancing blocks; reduces difficulty of manufacturing its counter balancing apparatus, and flexibly meets the requirement of moving mass for various moving-iron bone-conducted sound receiving devices by selection of different thickness and shapes of counter-balancing blocks.

18 Claims, 2 Drawing Sheets

(56) References Cited

U.S. PATENT DOCUMENTS

| | | | | |
|---|---|---|---|---|
| 5,757,947 | A * | 5/1998 | Van Halteren et al. | 381/417 |
| 5,809,158 | A * | 9/1998 | van Halteren et al. | 381/417 |
| 6,526,153 | B2 * | 2/2003 | Tibbetts | H04R 11/00 381/412 |
| 7,164,776 | B2 * | 1/2007 | Miller et al. | 381/418 |
| 7,203,334 | B2 * | 4/2007 | Schafer et al. | 381/418 |
| 7,869,610 | B2 * | 1/2011 | Jayanth et al. | 381/418 |
| 2004/0167377 | A1 * | 8/2004 | Schafer | H04R 7/06 600/25 |
| 2004/0258260 | A1 * | 12/2004 | Thompson | H04R 7/20 381/312 |
| 2007/0121983 | A1 * | 5/2007 | Jayanth | H04R 7/06 381/345 |
| 2014/0314253 | A1 * | 10/2014 | Zhou | H04R 1/02 381/162 |

OTHER PUBLICATIONS

Jan. 31, 2013 International Preliminary Report on Patentability issued in Application No. PCT/CN2012/076536.

* cited by examiner

COUNTER BALANCING APPARATUS FOR MOVING-IRON BONE-CONDUCTED SOUND RECEIVING DEVICE

TECHNICAL FIELD

The present invention relates to a vibration conduction and energy transduction device, and particularly relates to a counter balancing apparatus for moving-iron bone-conducted sound receiving device, which pertains to the field of electro-acoustic and micro-mechanics.

BACKGROUND OF THE INVENTION

At present, the commercial available counter balancing apparatuses for moving-iron bone-conducted sound receiving device are generally configured in a monoblock metal rectangular solid. This type of counter balancing apparatus is relatively easy to manufacture and process, however, when it is used in a product of moving-iron bone-conducted sound receiving device, because of the restriction of its external shape, it needs to occupy a lot of internal space of the product, which leads to problems such as too large size of product, and limited range of application, also, because the effective moving mass of the product cannot be increased due to its onefold shape, the transduction efficiency of the sound receiving system can be low and the output vibration level of the corresponding moving-iron bone-conducted sound receiving device can be insufficient. In brief, counter balancing apparatuses of the prior art generally have the deficiencies of shape redundancy, onefold structure, poor functionality, etc.

SUMMARY OF THE INVENTION

An objective of the present invention is to provide a counter balancing apparatus for moving-iron bone-conducted sound receiving device, which encompasses structural characteristics of conventional counter balancing designs and at the same time reasonably avoids their structural deficiencies, and, under the condition of enhancing transduction efficiency and output vibration level of the corresponding moving-iron bone-conducted sound receiving device, effectively controls the volume of the product, also, with flexible ways of its application, is able to meet the requirement of effective moving mass for various moving-iron bone-conducted sound receiving devices, thus overcomes deficiencies of the prior art.

In order to achieve the above-mentioned objective, the present invention provides a counter balancing apparatus for moving-iron bone-conducted sound receiving device, which comprises a baseboard and a counter-balancing block.

Preferably, the baseboard is configured in a planar structure, with an open notch on its front end; two sheets of counter-balancing blocks are also configured in a planar structure and are provided symmetrically on both sides of the baseboard, and an open notch formed on the front end of each of the counter-balancing blocks is aligned with the open notch on the front end of the baseboard.

The baseboard is bound to the counter-balancing block by mortise and tenon connection, laser welding, resistance welding, ultrasonic welding, or adhesive binding.

In order to coordinate with its functions and manufacturing process requirements, the baseboard is made of aluminum, aluminum-magnesium alloy, stainless steel, beryllium-copper, phosphorous-copper, red copper, yellow brass, titanium, or plastic; the counter-balancing block is made of platinum, gold, silver, red copper, beryllium-copper, phosphorous-copper, yellow brass, or titanium.

When the counter balancing apparatus is applied to a moving-iron bone-conducted sound receiving device, the driving and transduction part of the moving-iron bone-conducted sound receiving device is fixed to one sheet of the counter-balancing block; the vibration conduction apparatus of the moving-iron bone-conducted sound receiving device is configured to extend through the open notch of the counter balancing apparatus and is fixed to the bottom of the shielding case of the moving-iron bone-conducted sound receiving device; the back end of the baseboard of the counter balancing apparatus is in hinged connection with the inner wall of the shielding case of the moving-iron bone-conducted sound receiving device.

Specifically, the driving and transduction part of the moving-iron bone-conducted sound receiving device is connected to one sheet of the counter-balancing block by resistance welding, laser welding, or adhesive binding; the inner wall of the shielding case of the moving-iron bone-conducted sound receiving device is in hinged connection with the back end of the baseboard of the counter balancing apparatus in mortise and tenon connection manner, or in adhesive binding manner.

Compared to the prior art, the present invention has the following advantages:

(1) compared to the counter balancing apparatus in rectangular solid shape of the prior art, the present invention, on the basis of ensuring its basic functions, encompasses design advantages of the prior art apparatus and at the same time reasonably avoids structural deficiencies of the prior art apparatus, reasonably optimizes the space occupied by the counter balancing apparatus, significantly increases the effective moving mass of the counter balancing apparatus, so as to effectively control the size of the product under the condition of enhancing transduction efficiency and output vibration level of the corresponding moving-iron bone-conducted sound receiving device;

(2) compared to the monoblock structure of the counter balancing apparatus of the prior art, the split type design of the baseboard and the counter-balancing blocks in the present invention not only reduces the level of difficulty of manufacturing its counter balancing apparatus, but also flexibly meets the requirement of effective moving mass for various moving-iron bone-conducted sound receiving devices by selection of different thickness and shapes of counter-balancing blocks.

Figure 1:
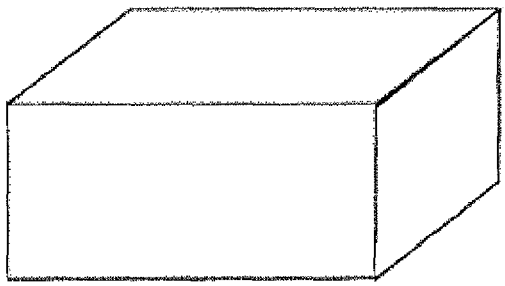
FIG. 1 is a structural schematic diagram of a counter balancing apparatus in monoblock rectangular solid shape of the prior art.

In the drawings, the marking numerals and their corresponding indicated components are as follows:

A1—baseboard, A2—counter-balancing block, A3—open notch;

B1—counter balancing apparatus, B2—vibration conduction apparatus, B3—shielding case, B4—transduction and driving apparatus.

DETAILED DESCRIPTION OF EMBODIMENTS

The technical solution of the present invention is further described below, in conjunction with appended drawings and preferred embodiments.

Figure 2:
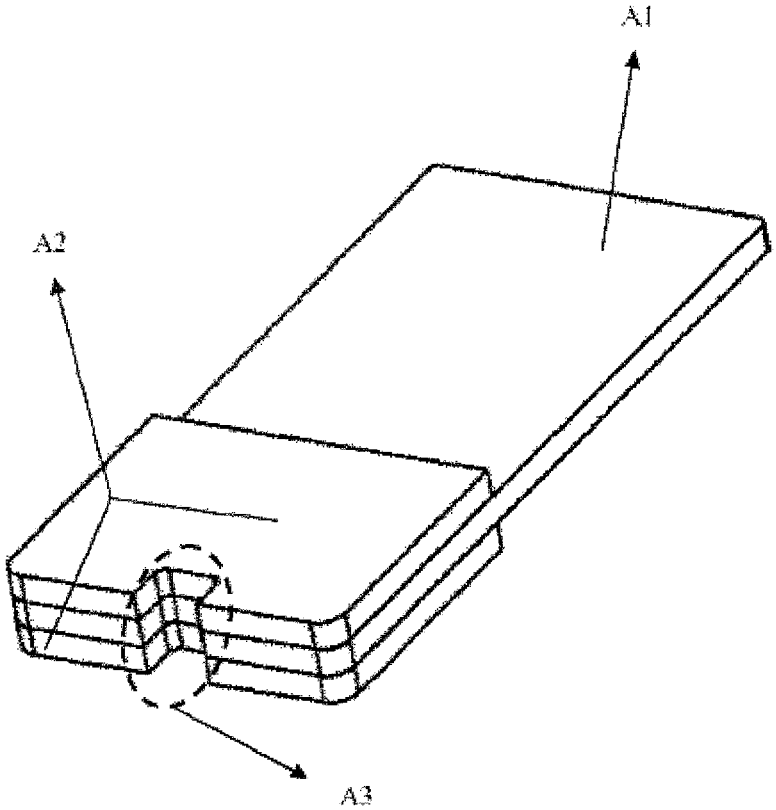
FIG. 2 is a structural schematic diagram of a counter balancing apparatus for moving-iron bone-conducted sound receiving device of the present invention.
Figure 3:
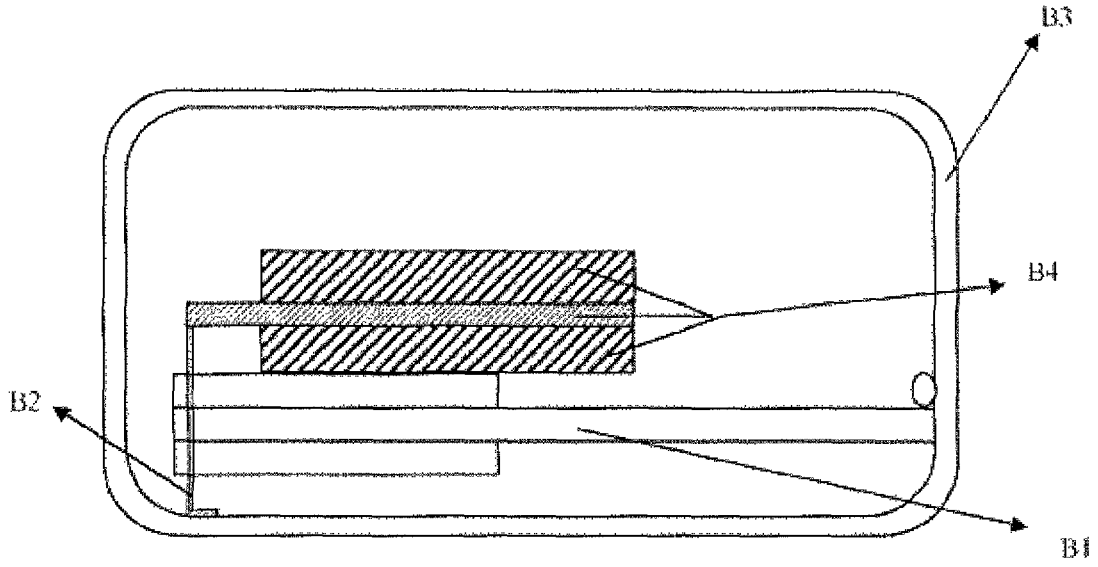
FIG. 3 is a cross-section structural schematic diagram of a counter balancing apparatus for moving-iron bone-conducted sound receiving device applied in a moving-iron bone-conducted sound receiving device.

Referring to FIG. 2 and FIG. 3, the present embodiment involves a counter balancing apparatus B1 for moving-iron bone-conducted sound receiving device, and the counter balancing apparatus B1 comprises a baseboard A1 and counter-balancing blocks A2. The baseboard A1 is configured in a planar structure, with an open notch A3 on its front end; two sheets of counter-balancing blocks A2 are also configured in a planar structure and are provided symmetrically on both sides of the baseboard A1, and an open notch A3 formed on the front end of each of the counter-balancing blocks A2 is aligned with the open notch A3 on the front end of the baseboard A1.

Preferably, the baseboard A1 and the counter-balancing blocks A2 of the counter balancing apparatus B1 in the present embodiment are bound together by laser welding, i.e. the material adjacent to the connection area of the baseboard A1 and the counter-balancing blocks A2 are melted by laser beam, and after cooling down and hardening, connection is achieved. In addition to this, alternative ways of connection also include mortise and tenon connection, resistance welding, ultrasonic welding, or adhesive binding.

In order to achieve functions of the counter balancing apparatus B1 and coordinate with process requirements of laser welding, the baseboard A1 in the present embodiment is preferably made of stainless steel, and the counter-balancing blocks A2 in the present embodiment are preferably made of titanium. In addition, the baseboard A1 may also be made of aluminum, aluminum-magnesium alloy, beryllium-copper, phosphorous-copper, red copper, yellow brass, titanium, or plastic; the counter-balancing blocks A2 may also be made of platinum, gold, silver, red copper, beryllium-copper, phosphorous-copper, or yellow brass.

When the counter balancing apparatus B1 in the present embodiment is applied to a moving-iron bone-conducted sound receiving device, the driving and transduction part B4 of the moving-iron bone-conducted sound receiving device is fixed to one sheet of the counter-balancing block A2; the vibration conduction apparatus B2 of the moving-iron bone-conducted sound receiving device is configured to extend through the open notch A3 of the counter balancing apparatus B1 and is fixed to the bottom of the shielding case B3 of the moving-iron bone-conducted sound receiving device; the back end of the baseboard A1 of the counter balancing apparatus B1 is in hinged connection with the inner wall of the shielding case B3 of the moving-iron bone-conducted sound receiving device.

During fabrication, in the present embodiment, the driving and transduction part B4 of the moving-iron bone-conducted sound receiving device is connected to one sheet of the counter-balancing block A2 by laser welding; the inner wall of the shielding case B3 of the moving-iron bone-conducted sound receiving device is in hinged connection with the back end of the baseboard A1 of the counter balancing apparatus B1 in mortise and tenon connection manner.

During operation, the transduction and driving apparatus B4 of the moving-iron bone-conducted sound receiving device generates mechanical vibration, and by means of the vibration conduction apparatus B2, the mechanical vibration force is exerted onto the bottom of the shielding case B3 which is in fixed connection with the vibration conduction apparatus B2; as one sheet of the counter-balancing block A2 thereof is in fixed connection with the transduction and driving apparatus B4, and as the back end of the baseboard A1 thereof is in hinged connection with the inner wall of the shielding case B3, the counter balancing apparatus B1 vibrates together with the transduction and driving apparatus B4, so as to enhance the level of vibration exerted onto the shielding case B3 by its own inherent mass. When the shielding case B3 has come into contact with the head of a user, the vibration force is further conducted to auditory nerve by means of the skull, so as to achieve the function of sound transmission.

Compared to the counter balancing apparatus in rectangular solid shape of the prior art, the present invention, on the basis of ensuring its basic functions, encompasses design advantages of the prior art apparatus and at the same time reasonably avoids structural deficiencies of the prior art apparatus, reasonably optimizes the space occupied by the counter balancing apparatus, significantly increases the effective moving mass of the counter balancing apparatus, so as to effectively control the size of the product under the condition of enhancing transduction efficiency and output vibration level of the corresponding moving-iron bone-conducted sound receiving device; moreover, compared to the monoblock structure of the counter balancing apparatus of the prior art, the split type design of the baseboard and the counter-balancing blocks in the present invention not only reduces the level of difficulty of manufacturing its counter balancing apparatus, but also flexibly meets the requirement of effective moving mass for various moving-iron bone-conducted sound receiving devices by selection of different thickness and shapes of counter-balancing blocks.

Further detailed description of the purposes, technical solution and beneficial effects of the present invention is given above, it should be understood that the aforementioned embodiments are merely preferred embodiments of the present invention and not intended for limiting the present invention, and any changes, equivalent alternatives or modifications made within the spirit and principle of the present invention are intended to be embraced within the protection scope of the present invention.

The invention claimed is:

1. A counter balancing apparatus for moving-iron bone-conducted sound receiving device, comprising a baseboard and a plurality of counter-balancing blocks, wherein the counter-balancing blocks are made of platinum, gold, silver, red copper, beryllium-copper, phosphorous-copper, yellow brass, or titanium, and wherein two of the counter-balancing blocks are configured in a planar structure and are provided symmetrically on both sides of the baseboard, and an open notch formed on the front end of each of the counter-balancing blocks is aligned with the open notch on the front end of the baseboard.

2. The counter balancing apparatus of claim 1, wherein, the baseboard is configured in a planar structure, with an open notch on its front end.

3. The counter balancing apparatus of claim 2, wherein, the baseboard is bound to the counter-balancing blocks by mortise and tenon connection, laser welding, resistance welding, ultrasonic welding, or adhesive binding.

4. The counter balancing apparatus of claim 2, wherein, when the counter balancing apparatus is applied to the moving-iron bone-conducted sound receiving device, the driving and transduction part of the moving-iron bone-conducted sound receiving device is fixed to one sheet of the counter-balancing blocks; the vibration conduction apparatus of the moving-iron bone-conducted sound receiving device is configured to extend through the open notch of the counter balancing apparatus and is fixed to the bottom of the shielding case of the moving-iron bone-conducted sound receiving device; the back end of the baseboard of the counter balancing apparatus is in hinged connection with the inner wall of the shielding case of the moving-iron bone-conducted sound receiving device.

5. The counter balancing apparatus of claim 1, wherein, the baseboard is bound to the counter-balancing blocks by mortise and tenon connection, laser welding, resistance welding, ultrasonic welding, or adhesive binding.

6. The counter balancing apparatus of claim 1, wherein, the baseboard is made of aluminum, aluminum-magnesium alloy, stainless steel, beryllium-copper, phosphorous-copper, red copper, yellow brass, titanium, or plastic.

7. The counter balancing apparatus of claim 1, wherein, when the counter balancing apparatus is applied to the moving-iron bone-conducted sound receiving device, the driving and transduction part of the moving-iron bone-conducted sound receiving device is fixed to one sheet of the counter-balancing blocks; the vibration conduction apparatus of the moving-iron bone-conducted sound receiving device is configured to extend through the open notch of the counter balancing apparatus and is fixed to the bottom of the shielding case of the moving-iron bone-conducted sound receiving device; the back end of the baseboard of the counter balancing apparatus is in hinged connection with the inner wall of the shielding case of the moving-iron bone-conducted sound receiving device.

8. The counter balancing apparatus of claim 7, wherein, when the counter balancing apparatus is applied to the moving-iron bone-conducted sound receiving device, the driving and transduction part of the moving-iron bone-conducted sound receiving device is connected to one sheet of the counter-balancing blocks by resistance welding, laser welding, or adhesive binding.

9. The counter balancing apparatus of claim 8, wherein, when the counter balancing apparatus is applied to the moving-iron bone-conducted sound receiving device, the inner wall of the shielding case of the moving-iron bone-conducted sound receiving device is in hinged connection with the back end of the baseboard of the counter balancing apparatus in mortise and tenon connection manner, or in adhesive binding manner.

10. The counter balancing apparatus of claim 1, wherein, the baseboard is bound to the counter-balancing blocks by mortise and tenon connection, laser welding, resistance welding, ultrasonic welding, or adhesive binding.

11. The counter balancing apparatus of claim 1, wherein, when the counter balancing apparatus is applied to the moving-iron bone-conducted sound receiving device, the driving and transduction part of the moving-iron bone-conducted sound receiving device is fixed to one sheet of the counter-balancing blocks; the vibration conduction apparatus of the moving-iron bone-conducted sound receiving device is configured to extend through the open notch of the counter balancing apparatus and is fixed to the bottom of the shielding case of the moving-iron bone-conducted sound receiving device; the back end of the baseboard of the counter balancing apparatus is in hinged connection with the inner wall of the shielding case of the moving-iron bone-conducted sound receiving device.

12. A counter balancing apparatus for moving-iron bone-conducted sound receiving device, comprising a baseboard and a plurality of counter-balancing blocks, wherein the baseboard is made of aluminum, aluminum-magnesium alloy, stainless steel, beryllium-copper, phosphorous-copper, red copper, yellow brass, titanium, or plastic, and wherein two counter-balancing blocks are configured in a planar structure and are provided symmetrically on both sides of the baseboard, and an open notch formed on the front end of each of the counter-balancing blocks is aligned with the open notch on the front end of the baseboard.

13. The counter balancing apparatus of claim 12, wherein, the baseboard is configured in a planar structure, with an open notch on its front end.

14. The counter balancing apparatus of claim 12, wherein, the baseboard is bound to the counter-balancing blocks by mortise and tenon connection, laser welding, resistance welding, ultrasonic welding, or adhesive binding.

15. The counter balancing apparatus of claim 12, wherein, the counter-balancing blocks are made of platinum, gold, silver, red copper, beryllium-copper, phosphorous-copper, yellow brass, or titanium.

16. The counter balancing apparatus of claim 12, wherein, when the counter balancing apparatus is applied to the moving-iron bone-conducted sound receiving device, the driving and transduction part of the moving-iron bone-conducted sound receiving device is fixed to one sheet of the counter-balancing blocks; the vibration conduction apparatus of the moving-iron bone-conducted sound receiving device is configured to extend through the open notch of the counter balancing apparatus and is fixed to the bottom of the shielding case of the moving-iron bone-conducted sound receiving device; the back end of the baseboard of the counter balancing apparatus is in hinged connection with the inner wall of the shielding case of the moving-iron bone-conducted sound receiving device.

17. The counter balancing apparatus of claim 16, wherein, when the counter balancing apparatus is applied to the moving-iron bone-conducted sound receiving device, the driving and transduction part of the moving-iron bone-conducted sound receiving device is connected to one sheet of the counter-balancing blocks by resistance welding, laser welding, or adhesive binding.

18. The counter balancing apparatus of claim 17, wherein, when the counter balancing apparatus is applied to the moving-iron bone-conducted sound receiving device, the inner wall of the shielding case of the moving-iron bone-conducted sound receiving device is in hinged connection with the back end of the baseboard of the counter balancing apparatus in mortise and tenon connection manner, or in adhesive binding manner.

* * * * *